US006141973A

United States Patent [19]

Whitmore

[11] Patent Number: 6,141,973

[45] Date of Patent: Nov. 7, 2000

[54] APPARATUS AND PROCESS FOR COOLING GAS FLOW IN A PRESSURIZED PIPELINE

[75] Inventor: Ward A. Whitmore, Anchorage, Ak.

[73] Assignee: Yukon Pacific Corporation, Anchorage, Ak.

[21] Appl. No.: 09/153,227

[22] Filed: Sep. 15, 1998

[51] Int. Cl.[7] ..... F25B 19/02

[52] U.S. Cl. ..... 62/51.2; 62/50.1

[58] Field of Search ..... 62/50.1, 51.2

[56] References Cited

U.S. PATENT DOCUMENTS

| | | | |
|---|---|---|---|
| 2,958,205 | 11/1960 | McConkey | 62/50.1 |
| 2,961,840 | 11/1960 | Goldtrap . | |
| 2,966,402 | 12/1960 | Hasche . | |
| 3,251,191 | 5/1966 | Reed . | |
| 3,298,805 | 1/1967 | Secord et al. . | |
| 3,733,838 | 5/1973 | Delahunty . | |
| 3,919,852 | 11/1975 | Jones . | |
| 3,995,440 | 12/1976 | Wengen . | |
| 4,192,655 | 3/1980 | Von Linde . | |
| 4,269,539 | 5/1981 | Hopke . | |
| 4,372,332 | 2/1983 | Mast . | |
| 4,563,203 | 1/1986 | Weiss et al. . | |
| 4,727,723 | 3/1988 | Durr . | |
| 4,921,399 | 5/1990 | Lew . | |
| 5,036,671 | 8/1991 | Nelson et al. . | |
| 5,327,730 | 7/1994 | Myers et al. . | |
| 5,372,010 | 12/1994 | Gratz . | |
| 5,386,699 | 2/1995 | Myers et al. . | |
| 5,582,012 | 12/1996 | Tunkel et al. . | |
| 5,778,917 | 7/1998 | Whitmore et al. . | |

FOREIGN PATENT DOCUMENTS

| | | |
|---|---|---|
| 4223160 | 1/1994 | Germany . |
| 1390476 | 4/1988 | U.S.S.R. . |
| 1030600 | 5/1966 | United Kingdom . |
| 1596330 | 8/1981 | United Kingdom . |

*Primary Examiner*—Ronald Capossela
*Attorney, Agent, or Firm*—Richard C. Litman

[57] ABSTRACT

An apparatus and process for cooling gas flow in a pressurized pipeline, comprises the installation of one or more Joule-Thomson expansion valves along the length of the pipeline. The valve permit precise control of the temperature of the gas in the line, and accordingly the line itself, for passage through continuous or discontinuous areas of permafrost. The present invention allows precise control of the temperature of such a gas pipeline at predetermined points, to operate either in a warm mode (above the freezing point of water) or cold mode (below the freezing point of water). It is important that the temperature characteristics of the pipeline closely match those of the adjacent terrain or soil, to preclude settling of a warm pipe by melting adjacent permafrost soil, and to preclude frost heaves caused by ice buildup around a cold pipe in thawed ground. The present invention provides for the installation of Joule-Thomson expansion valves at predetermined points where precise control of the temperature from warm to cold mode is critical. The valves may be installed in series with the line, or in parallel with isolation shutoff valves required at various points in the line.

16 Claims, 2 Drawing Sheets

10

10

APPARATUS AND PROCESS FOR COOLING GAS FLOW IN A PRESSURIZED PIPELINE

BACKGROUND OF THE INVENTION

1. Field of the Invention

The present invention relates generally to means for controlling pressure and temperature in a pipeline for compressible fluids, and more specifically to the installation and use of a Joule-Thomson type expansion valve at predetermined locations in such a line, in order to achieve precise control of the temperature of the gas flowing in various portions of the line. By routing all of the gas through such a Joule-Thomson valve, and regulating the flow through the valve to produce the desired pressure drop across the valve, temperature drop to a predetermined desired temperature is also achieved.

2. Description of the Related Art

The discovery of oil and gas deposits in Arctic and sub-Arctic areas of the world has led to a need for transporting such products from their source, to other areas for further shipping or distribution. In most cases, the most efficient means of transporting the oil and gas from the source to other areas, is by means of a relatively high capacity pipeline, due to constraints on shipping in such arctic areas during much of the year.

However, most such areas are subject to either continuous or discontinuous permafrost conditions, which leads to various problems with a pipeline carrying a compressible fluid (e.g., natural gas) thereacross. Typically, the gas is pumped at considerable pressure into the line, in order (1) to provide the required force to move the gas through the line, and (2) to increase the density of the gas in order to make the transport more efficient. It is well known that in accordance with physical laws governing the temperature and pressure of such a compressible fluid in a closed system, that as the pressure is increased, so does the temperature increase. Thus, if nothing is done to reduce the temperature of the gas, it is typically somewhat above the freezing point of water as it leaves the pumping or compressor station. If the pipeline is placed directly on or in close proximity to the permafrost terrain, the ice of the permafrost will be melted due to heat transfer from the relatively warm gas and pipe. This can cause the pipe to sink into the thawed ground and sag, potentially damaging the pipe.

On the other hand, the cooling of the gas to a temperature below the freezing point of water may also lead to problems. In areas where the permafrost is discontinuous, or where the upper layer of soil (known as the active layer) has thawed during the warm season, the cooling of the gas (and associated pipeline) to a temperature below freezing, can lead to ice formation below and around the pipe. A combination of cold pipe temperature, presence of ground water, and frost susceptible soils, can result in frost heaving around the pipe either raising the pipe and/or inducing stress on the pipe.

Typically, gas pipelines in continuous or discontinuous permafrost conditions have been designed to operate entirely in either the warm mode, i.e., above zero degrees Celsius, or the cold mode, i.e., below zero degrees Celsius, between compressor stations. It will be seen that this is not a completely satisfactory solution to the above described problems of thaw settlement and frost heave, as the soil conditions are likely to change between compressor stations. Also, the operation of a section of pipeline in either the entirely warm or entirely cold mode between compressor stations, results in relatively high gas and pipeline temperatures immediately downstream of the compressor for pipelines operating in the warm mode, or in quite cold gas and pipeline temperatures close to the next compressor station downstream for pipelines operating in the cold mode. This is due to the frictional pressure losses in the gas flow through the pipe, and the resulting drop in temperature of the gas downstream of each compressor station.

Accordingly, relatively high or low pipeline operating temperatures may be avoided by operating in the warm mode for a portion off its length immediately downstream of a compressor station, with the temperature transitioning to the cold mode (below freezing) at some intermediate point between compressor stations.

It will be seen that there is a need for some means of providing precise transition points between warm and cold operation of a gas pipeline at precisely predetermined locations along the length of the pipeline between compressor stations, in order to alleviate or obviate the effects of freezing and thawing on the underlying soil. The present invention meets this need by the placement of Joule-Thomson valves at predetermined points along the length of the pipeline, between compressor stations or other facilities along the line, and by adjusting the pressure drop across the valves in accordance with the pressure in the pipeline in order to achieve the desired gas and pipeline temperatures upstream and downstream of the valve. A discussion of the related art of which the present inventor is aware, and its differences and distinctions from the present invention, is provided below.

U.S. Pat. No. 2,961,840 issued on Nov. 29, 1960 to Walter A. Goldtrap, titled "Storage Of Volatile Liquids," describes the provision of a pit with refrigeration means extending thereacross. The pit is filled with water, and the refrigeration means is used to freeze a layer of ice across the pit. The water is drained, and the pit with its ice roof is used for the storage of various petroleum gases, such as butane, propane, etc. The Goldtrap storage system is not directed to the control of temperature of a moving fluid through a closed system, and provides no means of controlling differential pressures across a valve in a gas flow, as does the present invention.

U.S. Pat. No. 2,966,402 issued on Dec. 27, 1960 to Rudolph L. Hasche, titled "Treatment Of Natural Gas In Distribution Systems," describes a system for stripping heavier molecular weight gases from lighter gases at a distribution station. The gas is cooled to separate heavier molecules before any pressure drop is accomplished, with lighter gases then passed through an expansion engine to perform work and simultaneously reduce their temperature. The cooled and expanded gases are then warmed by passage through a heat exchanger, before distribution. The present invention teaches away from warming or compositional changes of gases, and serves only to cool gases and correspondingly drop the pressure across a Joule-Thomson valve at an intermediate point in a gas pipeline.

U.S. Pat. No. 3,251,191 issued on May 17, 1966 to Edwin E. Reed, titled "Frozen Earth Storage For Gas," describes a frozen earth storage system for natural gas, similar to the system described further above in the Goldtrap '840 U.S. patent. However, the Reed system is primarily directed to obviating any requirement for cooling of gases being added at ambient temperature to the system. This is accomplished by allowing the gas to vaporize from a high pressure liquid, to a cold vapor at ambient pressure. The vapor is then compressed and refrigerated using the refrigeration system for the gas reservoir. Reed does not disclose any provision of a Joule-Thomson valve in a gas transport pipeline system, nor does he teach the placement of such a valve at a predetermined position in the line in order to achieve predetermined temperatures upstream and downstream of the valve.

U.S. Pat. No. 3,298,805 issued on Jan. 17, 1987 to Herbert C. Secord et al., titled "Natural Gas For Transport," describes a method of storing natural gas for transport by ship, comprising cooling and pressurizing the gas mixture to achieve a density for compact storage during transport. Secord et al. teach away from the present invention, which is directed to the expansion of gas in a pipeline for reducing the temperature of the gas.

U.S. Pat. No. 3,733,838 issued on May 22, 1973 to Terry W. Delahunty, titled "System For Reliquifying Boil-Off Vapor From Liquefied Gas," describes two embodiments of gas cooling or refrigeration systems, wherein a cooled liquefied gas is pumped through a heat exchanger and back to a storage tank. The heat exchanger serves to cool relatively warmer vaporized gases from the storage tank, or from another source. Delahunty does not disclose the use of an expansion valve for reducing the pressure of gas in the system, and thus the temperature of the gas in the system, and controlling the expansion valve to provide a predetermined pressure, and thus temperature, decrease. Also, the present system is not adapted for use with liquefied gas.

U.S. Pat. No. 3,919,852 issued on Nov. 18, 1975 to James K. Jones, titled "Reliquefaction Of Boil Off Gas," describes a system using a refrigerant to cool the gas. Some of the boil off gas is used to drive a turbine, which is used to power the refrigeration system. In contrast, the present invention does not utilize any external refrigerant, but uses only a Joule-Thomson valve to provide the required drop in pressure and temperature.

U.S. Pat. No. 3,995,440 issued on Dec. 7, 1976 to George E. Wengen, titled "Vapor Control System," describes a system for recovering benzene vapors from a tank truck loading operation. The system uses the cooling effect of natural gas expansion at a distribution station, to cool an intermediate coolant which is then used to cool the benzene vapors. The present system is not used to cool any other fluid, but rather serves to cool the fluid or gas itself at predetermined points and to predetermined temperatures along a gas transportation pipeline, as desired.

U.S. Pat. No. 4,192,655 issued on Mar. 11, 1980 to Robert von Linde, titled "Process And Apparatus For The Conveyance Of Real Gases," describes a gas to gas heat exchanger installed with a compressor station along a gas pipeline. The system serves to cool gas exiting the compressor by using the temperature of the gas at the entrance or suction side of the compressor. The present invention does not utilize any form of intercooling between the gases at each side of a compression stage, but rather provides one or more expansion valves located separately from any compressor stations or other facilities along such a pipeline. It will be seen that the von Linde system may be disadvantageous in certain situations, as it may cool the exit gas to a lower than desired temperature, particularly when the drop in pressure and temperature between the exit of the first compressor and the next compressor in the line are considered. The present invention responds to this problem by providing pressure, and thus temperature, adjustments along the route of the pipeline between compressor stations.

U.S. Pat. No. 4,269,539 issued on May 26, 1981 to Scott W. Hopke, titled "Method For Preventing Damage To A Refrigerated Gas Pipeline Due To Excessive Frost Heaving," describes the addition of heat pipes adjacent a buried pipeline, in order to preclude the buildup of ice around the pipe and subsequent frost heaving in areas subject to intermittent thawing and freezing. The present invention responds to this problem by means of controlling the temperature of the gas flowing through the pipeline, and thus the temperature of the pipeline itself. Hopke does not utilize any expansion valve means for reducing the temperature of the gas within the pipe, as would already have to be in cold mode, i.e., below the freezing point of water, in order for the Hopke heating system to be required.

U.S. Pat. No. 4,372,332 issued on Feb. 8, 1983 to Burton T. Mast, titled "Compression Station For Arctic Gas Pipeline," describes a system in which relatively low pressure gas arriving at the station is preheated by using the heat of compressed gas from the downstream side of the compressor, somewhat like the von Linde '655 U.S. patent discussed further above. However, Mast then passes the compressed gas through a heat exchanger in order to lower the temperature of the compressed gas further. The reason for this apparatus is to avoid further pressure drops in the exit side of the line from the compressor, while still cooling the gas to the desired temperature. The present invention provides the desired temperature decrease at the desired predetermined point(s) in the line, using expansion valve(s)

U.S. Pat. No. 4,563,332 issued on Jan. 7, 1986 to Irving Weiss et al., titled "Refrigeration From Expansion Of Transmission Pipeline Gas," describes the expansion of gas to a pressure below the desired output pressure to the next stage, in order to obtain greater refrigeration from the expanded gas as its temperature is lowered. The gas is then compressed to the desired output pressure by a turbo-expander, which is operated by the expansion of the gas as its pressure is reduced at the first stage of the operation. The present invention does not reduce the gas pressure below the subsequent pressure stage at the next section of pipeline, nor is any compression stage used in the present invention, unlike the Weiss et al. apparatus.

U.S. Pat. No. 4,727,723 issued on Mar. 1, 1988 to Charles A. Durr, titled "Method For Sub-Cooling A Normally Gaseous Hydrocarbon Mixture," describes a system for liquefying a gas having various fractions of differing molecular weights, by separating the lightest weight fractions having the lowest condensation temperatures, and using those fractions as a refrigerant. The process uses conventional compression and heat exchange of the compressed gas for refrigeration. The present invention does not utilize any compression means, other than relying upon the compressor station(s) to provide flow through the expansion valve(s) of the present invention, in order to provide the desired temperature drop at the location of each expansion valve in the system.

U.S. Pat. No. 4,921,399 issued on May 1, 1990 to Lawrence E. Lew, titled "Gas Pipeline Temperature Control," describes a system using the recycle cooler of a compressor for cooling a portion of the exit gases and mixing the cooled gases with the output from the compressor, to lower the average temperature of the output gases in order to avoid thermal damage to the pipe at that point. The present system does not provide any division of the gas or partial routing of a fraction of the gas in order to accomplish the desired goal. Moreover, Lew is silent regarding any temperature adjustment at any point other than in the compressor station, while the present invention addresses the problem of temperature control at points intermediate between compressor stations.

U.S. Pat. No. 5,036,671 issued on Aug. 6, 1991 to Warren L. Nelson et al., titled "Method Of Liquefying Natural Gas,"

describes a system for refining natural gas, particularly for removing nitrogen gas therefrom. The system comprises compressing the gas mix to above atmospheric pressure, cooling and liquefying the pressurized gas through one or more refrigeration cycles, and expanding the gas to allow the lighter gases, such as nitrogen, to pass to the gaseous phase while the heavier hydrocarbon gases remain in the liquid phase. The present invention is not directed to the separation of any fraction of gases in the gases passing through the system, but rather to an apparatus and process for reducing the temperature to a predetermined point, of all of the gas passing through the system at some predetermined point.

U.S. Pat. No. 5,327,730 issued on Jul. 12, 1994 to Albert H. Myers et al., titled "Method And Apparatus For Liquifying Natural Gas For Fuel For Vehicles And Fuel Tank For Use Therewith," describes a system utilizing a secondary refrigerant, e.g., nitrogen gas, to cool the natural gas to the desired temperature and density for storage in a tank. The present system does not utilize any other refrigerant gases or fluid flows other than the gas which is flowing through the pipeline system with which the present invention may be used.

U.S. Pat. No. 5,372,010 issued on Dec. 13, 1994 to Gunther Gratz, titled "Method And Arrangement For The Compression Of Gas," describes a system for compressing gas for transport through a gas pipeline. Gratz compresses the gas to a pressure higher than that desired for the exit pressure from the compressor, which raises the gas to a higher temperature than desired. The hot gas is then passed through a heat exchanger, before expansion and further cooling to exit the compressor at the desired pressure and temperature. The excessive heating of the gas in the compression stage provides a greater difference between the initial gas temperature and the heat exchange medium, thus making the heat exchange operation more efficient. As in other pipeline compression systems of the prior art, Gratz is concerned with output pressure from the compressor, and teaches away from the use of a Joule-Thomson expansion valve to lower the temperature of the gas by lowering gas pressure, whereas the present invention uses the pressure drop through an expansion valve to reduce temperature.

U.S. Pat. No. 5,386,699 issued on Feb. 7, 1995 to Albert H. Myers et al., titled "Method And Apparatus For Liquifying Natural Gas For Fuel For Vehicles And Fuel Tank For Use Therewith," describes a system closely related to the system of the '730 U.S. patent to the same inventors, discussed further above. The same points of distinction between that system and the present invention, are felt to apply here.

U.S. Pat. No. 5,582,012 issued on Dec. 10, 1996 to Lev Tunkel et al., titled "Method Of Natural Gas Pressure Reduction On The City Gate Stations," describes a system wherein the incoming gas is split into two lines, with gas from one line being passed to a vortex tube and gas in the second line being passed to a conventional heating system in order to obviate excessive temperature drop. The gas from the vortex tube is split, with a fraction of that gas being passed through a heating system. The object of the Tunkel et al. system is to reduce the demands on a single heater, which would be required to heat all of the gas, and to reduce the total heating requirement for the gas. The present invention serves to cool the gas by reducing its pressure at some intermediate point in the line, and teaches away from heating the gas. Moreover, the present invention processes all of the gas passing through the system, rather than dividing the gas into two or more fractions, as is done with the Tunkel et al. system. Tunkel et al. do not use a Joule-Thomson expansion valve for the reduction of pressure in their system, as they do not desire the accompanying temperature decrease.

U.S. Pat. No. 5,778,917 issued on Jul. 14, 1998 to Ward A. Whitmore et al., titled "Natural Gas Compression Heating Process," describes a process for regulating the temperature of gas flowing through a pipeline, by providing intermediate relatively low compression stages between conventional compressor stations. The relatively low compression at the intermediate stages does not require post-compression cooling, as is generally the case with conventional systems. However, the Whitmore et al. '917 U.S. patent does not consider the need for controlling the temperature of the gas by cooling at intermediate points between compressor stations, which need is responded to by the present invention.

British Patent Publication No. 1,030,600 published on May 25, 1966 to Sulzer Brothers Ltd., titled "Improvements Relating To The Liquefaction Of Gases With Low Boiling Points," describes a process for optimizing the liquefaction of a gas such as helium. The process involves compressing the gas and then cooling the gas below its inversion temperature, i.e., to a point where the Joule-Thomson effect is positive for such a gas. Several other heat exchange, compression, and expansion steps are involved, with the end result being the liquefaction of the gas. The present invention is not directed to the liquefaction of a gas, and does not involve dividing the gas flow into two or more components, as does the Sulzer Brothers Ltd. system. The present system provides for the control of the temperature of gas flowing through a pipeline to a predetermined temperature well above the liquefaction point, using only an expansion valve and the energy of the gas flow.

British Patent Publication No. 1,596,330 published on Aug. 26, 1981 to Constructors John Brown Ltd. et al., titled "Gas Liquefaction," describes a system for liquefying natural gas for shipboard transport, particularly from an offshore site. The system involves a heat exchange process between the gas in the gaseous state and a liquefied gas (e.g., liquefied air or nitrogen), resulting in the vaporizing of the liquefied gas, which has a boiling point lower than that of methane at standard atmospheric pressure. The present system does not involve heat exchange with another gas, particularly an atmospheric gas with such a low boiling point.

Soviet Patent Publication No. 1,390,476 published on Apr. 23, 1988 provides a schematic illustration of an automated control system for a gas pipeline. No specific mechanism for controlling the characteristics of the gas flow (pressure and temperature) are apparent in the Soviet Patent Publication, as opposed to the Joule-Thomson expansion valve means used in the present invention.

Finally, German Patent Publication No. 4,223,160 published on Jan. 13, 1994 to Gunther Gratz illustrates a system for the compression of a gas in a gas pipeline. The German Patent Publication is the parent document for the '010 U.S. patent issued to the same inventor, and discussed further above. The same points of difference raised in that discussion, are seen to apply here.

None of the above inventions and patents, taken either singly or in combination, is seen to describe the instant invention as claimed.

SUMMARY OF THE INVENTION

The present invention comprises an apparatus and process for cooling gas flow in a pressurized pipeline, particularly for controlling gas and pipeline temperatures in areas of continuous and discontinuous permafrost. The invention comprises the installation of one or more Joule-Thomson expansion valves in the pipeline at predetermined locations, according to the desired temperatures at those locations along the pipeline. By reducing the pressure of the gas as it flows through the expansion valve, the temperature is also reduced. The valve(s) may be sized or regulated to produce the desired temperature decrease, and are preferably adjustable to accommodate seasonal changes.

The present expansion valves may be used to provide transition between warm and cold operating modes, i.e., where the gas is above the freezing point of water to a temperature at or below the freezing point of water, as when the pipeline is passing through an area of continuous or discontinuous permafrost. By positioning a valve at a predetermined location, e.g., where the flowing temperature of the pipeline is above the freezing point of water, the pressure differential across the valve may be adjusted to assure that the gas and pipeline temperature on the upstream side of the valve remains in the warm operating mode, with temperature on the downstream side of the valve transitioning to the cold mode for passage through permafrost conditions.

Alternatively, the valves may be used to lower the temperature further in a pipe operating in a cold mode, in order to assure that the line will remain in the cold mode regardless of any diurnal or seasonal temperature changes which may otherwise affect the pipe temperature. This is particularly critical in areas of permafrost, where operation of the line at temperatures above freezing at any point, will likely lead to thawing of the soil adjacent to the line and possible damage to the line due to settling.

Accordingly, it is a principal object of the invention to provide an improved apparatus for the control of temperature in a gas pipeline, comprising the installation of one or more expansion valves in the pipeline.

It is another object of the invention to provide an improved apparatus in which the expansion valves are operated in parallel with the pipeline, with the pipeline including a shutoff valve therein for routing all of the gas through the expansion valve.

It is a further object of the invention to provide an improved apparatus in which the expansion valve is regulated to provide a predetermined pressure drop across the valve, and thus a predetermined temperature at the exit from the valve.

An additional object of the invention is to provide an improved process for controlling the temperature in a gas pipeline, comprising installing at least one expansion valve at a predetermined location in the pipeline and adjusting the valve to provide a predetermined pressure differential and corresponding temperature drop across the valve.

Still another object of the invention is to provide an improved process which may be adapted for operation in a pipeline operating in either the warm or the cold mode, for providing a precise transition from warm to cold mode or for assuring that operation remains in the cold mode, as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
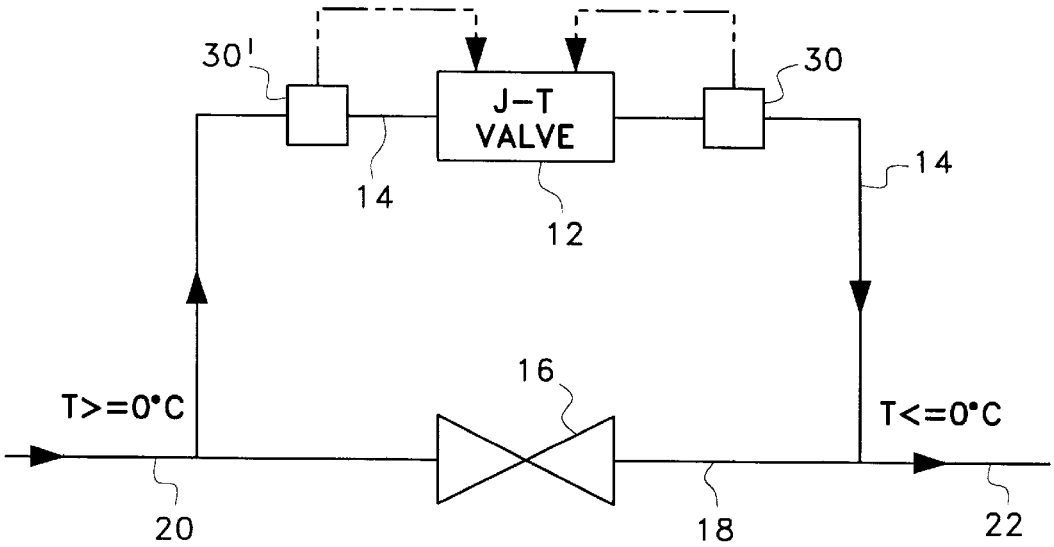
FIG. 1 is a schematic view of the installation of a Joule-Thomson expansion valve in a gas pipeline system, for controlling pipeline temperatures from a warm mode to a cold mode of operation.

The present invention comprises an apparatus and process for cooling gas flow in a pressurized pipeline, as used in the transportation of natural gas in the Arctic and sub-Arctic regions. Typically, such gas is compressed to a very high degree, on the order of 2,200 psig (pounds per square inch, gauge reading) or more, which raises the temperature of the gas in accordance with known physical gas laws (i.e., Boyle's and Charles's Laws). The gas is then cooled to about the freezing point of water under standard pressure, or about zero degrees Celsius. Conventionally, some form of heat exchange and/or mechanical refrigeration means is used for this cooling step. Frictional losses through the pipeline result in a pressure drop between compressor stations along the line, with the pressure drops resulting in temperature drops in accordance with the above referenced gas laws.

The pressure drops in the length of the pipeline require periodic repressurizing of the gas in order to provide efficient flow of the gas through the entire length of the line, which may run for several hundred miles. This repressurization of the gas is usually by means of relatively high volume, low differential pressure compressors, such as turbine compressors, in order to preclude heating the gas to a great degree and also to handle the volume of gas flowing through the line.

It is important to maintain the pipe, and thus the gas within the pipe which conducts its Temperature to the pipe, at a temperature appropriate to the ambient terrain. Most, if not all, of the terrain across which Arctic and sub-Arctic pipelines are run, comprises continuous or discontinuous permafrost. As noted further above, a pipeline having a temperature above the freezing point of water, or zero degrees Celsius, in permafrost, will result in the ice melting and the potential for pipe settling or sagging into the terrain, with undesirable loads being imposed on a pipe over any appreciable span. Alternatively running a pipe at below freezing temperatures in ground which is above freezing, may result in ice forming around the pipe, with the expansion of the frost susceptible soils as they freeze resulting in a frost heave which may push the pipe completely out of the ground.

Accordingly, it will be seen that precise temperature control of the gas flowing through a pipeline in Arctic and sub-Arctic conditions, is critical to the well being of the pipeline. Typically, pipeline systems have been constructed to operate entirely in either the warm mode, i.e., with the gas above zero degrees Celsius, or the cold mode, i.e., with the gas below zero degrees Celsius, for the entire length of a run between compressor stations. However, due to the pressure and corresponding temperature drop between stations, this results in a relatively warm gas temperature, i.e., several degrees above freezing, at the discharge of the upstream compressor station in order to maintain a temperature above freezing by the time the lower pressure gas arrives at the suction or entry end of the next compressor downstream. Conversely, operation in the cold mode for the entire distance, results in the lower pressure gas being several degrees below freezing by the time it arrives at the suction end of the next compressor station.

It will be seen that such operations are less than desirable where pipeline flow and ambient conditions may change with changing seasons, and accordingly, some thought has been given to warming or cooling the gas at intermediate points between compressor stations, by mechanical or heat exchanger means. The art is silent regarding the use of the expansion means of the present invention for cooling the gas at some intermediate point between compressor stations.

The present invention contemplates sufficient compressor surplus power to more than compensate for the relatively small pressure drop which occurs when using the present apparatus to lower the gas temperature only a few degrees. In fact, as the present device requires no external energy input for operation (other than instrumentation), it will be seen that there may well be a net savings in energy, by eliminating any need for intermediate mechanical heating or cooling systems between compressor stations. Also, the present cooling means is adaptable to high or low pressure pipelines, and may be used with dense phase gases, in which there are no distinct gas and liquid phases.

FIG. 1 provides a schematic view of a first embodiment of the present invention, which might be used in an area of discontinuous permafrost. A pressurized gas pipeline 10 includes a Joule-Thomson expansion valve 12 installed in a branch as bypass section 14 thereof with a shutoff valve 16 disposed within main section 18 of the line 10. The Department of Transportation rules require isolation valves to be placed in the pipeline 10 at various locations in the line, in order to shut off flow along a given section of pipe. Accordingly, the J-T valve 12 of the present invention could be placed in a parallel loop 14 at an isolation valve, such as the shutoff valve 16, or in other sections of the pipe 10 as desired. In fact, the isolation valves could be positioned with the J-T valves as desired along the length of the pipeline, to provide maximum efficiency for the J-T valves.

Alternatively, it will be seen that such J-T valves 14 could be placed in series with the pipeline 10, by eliminating the pipe section 18 having the shutoff valve 16 installed therein. Such series placement of the J-T valves in the mainline pipe would be applicable to pipeline systems which will not require periodic "pigging," or remote internal inspection, of the line. In fact, a series of two or more such J-T valves 12 could be placed along the length of such a pipeline 10 at predetermined locations, according to the temperature drop desired at each of the locations. Such J-T valves may be provided with conventional adjustment or regulation means, which are known in the art for controlling or regulating the pressure drop (and thus the temperature drop) of gas flowing through the valve. Such regulated valves are also known as "throttle valves," and in fact serve to adjustably control the gas flow therethrough, in the manner of a throttle for an engine.

In FIG. 1, the J-T valve 12 is located along the pipeline such that the temperature of the entry gas at location 20 immediately upstream of the J-T valve 12, is above the freezing point of water, or greater than zero degrees Celsius, as indicated. This would be the case for pressurized gas downstream of a compressor, compression heater, heater or other station, where the station discharge gas has not been cooled to below freezing. This is known as the "warm mode" of operation, when the gas in a section of pipe is at a temperature above freezing. Accordingly, all gas may be routed through the J-T valve 12 by shutting off flow at the shutoff valve 16 (or by placing the J-T valve 12 in series in the pipe 10, as noted further above) with the expansion of gas flowing through the J-T valve 12 resulting in a drop in pressure, and a corresponding drop in temperature. The pressure drop, and corresponding temperature drop, may be regulated by known means in order to achieve the desired exit gas temperature.

In the example of FIG. 1, the pressure has been reduced sufficiently to result in a temperature drop to at or below the freezing point of water, as indicated at the exit or discharge location 22 of the system. The gas flow downstream from the exit point 22, i.e., to the right in FIG. 1, will remain at or below the freezing point until reaching another compressor station, due to the inherent drop in pressure due to friction within the pipe, and corresponding drop in temperature. Thus, the below freezing gas within the pipe is compatible for passage through or across areas of permafrost conditions.

Figure 2:
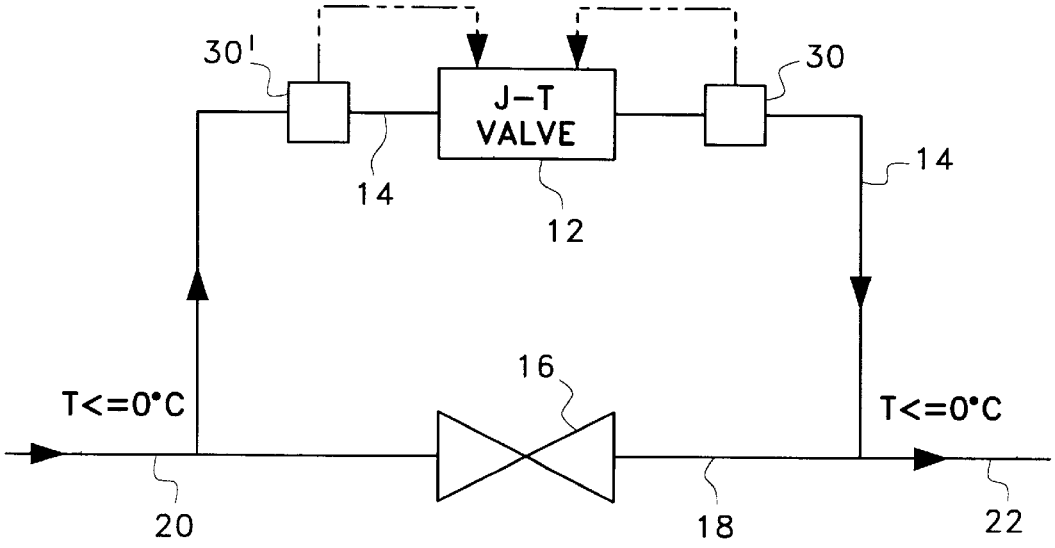
FIG. 2 is a schematic view of the installation of a Joule-Thomson expansion valve in a gas pipeline system, for controlling pipeline temperatures from a cold mode to a colder mode.

FIG. 2 provides a schematic view of a second embodiment of the present invention, where the incoming gas is at a temperature at or below the freezing point of water, with the pipe operating in the "cold mode." The configuration of the system of FIG. 2 is identical to that of FIG. 1, with a pressurized gas pipeline 10 having at least one (or a plurality of) Joule-Thomson expansion valves 12 installed in a section 14 of the pipe 10 at some predetermined location thereof. As in the embodiment of FIG. 1, the bypass pipeline 14 may comprise a parallel loop associated with a shutoff or isolation valve 16 in the main pipeline 18, or may be in series with the pipe 10, by eliminating the shutoff valve 16 and its section of pipe 18. In any event, all of the gas flowing through the pipe 10 is routed through the J-T valve(s) 12, rather than passing only a fraction of the gas through the valve(s) 12 with the remainder passing through the shutoff valve 16.

The primary difference between FIG. 1 and FIG. 2, is that the temperature of the entry gas immediately upstream of the J-T valve 12, at location 20, is at or below the freezing point of water, with the pipe operating in the "cold mode." The J-T valve in the system 10 of FIG. 2, serves to expand the gas passing therethrough to drop the pressure and corresponding temperature further, so the gas remains below the freezing point at the exit or discharge location 22. Such an operation with the pipe operating entirely in the cold mode, both upstream and downstream of the valve 12, is compatible for pipelines in permafrost areas.

Seasonal changes in the temperature of the permafrost terrain over or through which the pipe 10 may be laid, including variation in the active layer depth, may influence the flowing temperature of the pipeline. Accordingly, it is desirable to provide some means of adjusting the pressure drop across the J-T expansion valve 12 used with the present invention. Conventional automated monitoring and control means, such as a thermostat controlling a regulator within valve 12, may be used in order to maintain the predetermined exit gas temperature/pressure. A temperature sensor and/or controller 30 may be installed at the outlet point of valve 12 for such monitoring, with the regulator controlling the partial opening or closing of the valve 12 to adjust the pressure and corresponding temperature drop as required. As the pressure and temperature characteristics of the gas are directly interrelated, it will be seen that a pressure transducer may be used to provide control, if so desired.

Also, the location of the valve(s) 12 and operation of the upstream station may be used to control a predetermined temperature of the pipeline gas upstream of the valve(s) 12. A conventional temperature/pressure sensor and/or controller 30 may be installed immediately upstream of the valve(s) 12 to provide a temperature indication required to regulate control of equipment upstream of the valve(s) 12 in order to maintain the upstream pressure and/or temperature as desired in either the warm or the cold mode. Such temperature sensors could be installed at some distance from the valve(s) 12 as desired, with signals from the sensors being used to control the valve(s) 12 or upstream facilities remotely at some distance, if so desired.

As noted above, relatively long gas pipelines conventionally include several compressor stations disposed periodically along the route of the line, to compensate for frictional pressure losses along the length of the line, and to maintain a warm or cold operational mode across areas where such is desired. Additionally, heaters and/or coolers may be located along the pipeline to control the flowing temperature of the pipeline. The present invention provides for installation of one or more J-T valves interspersed with the series of spaced apart compressor stations or other facilities installed along the line. Thus, as each station or facility adjusts the pressure and/or temperature of the gas in the line, one or more Joule-Thomson expansion valves 12 may be installed therewith or at some distance therefrom to control the temperature of the gas along the pipeline, as predetermined according to the characteristics of the terrain through which each section of the pipeline passes.

Compressor stations typically include some means for lowering the temperature of the exit gas from the station. Accordingly, the means for controlling the inlet gas temperature at a J-T valve downstream from the station, may comprise controlling the outlet temperature of the gas from the upstream compressor station. As the frictional pressure losses and thus the temperature reductions, through a given length of pipeline are well known and established, such adjustment of the exit gas temperature at the upstream compressor station relative to the J-T valve, will correspondingly regulate the inlet temperature at the downstream J-T valve.

Figure 3:
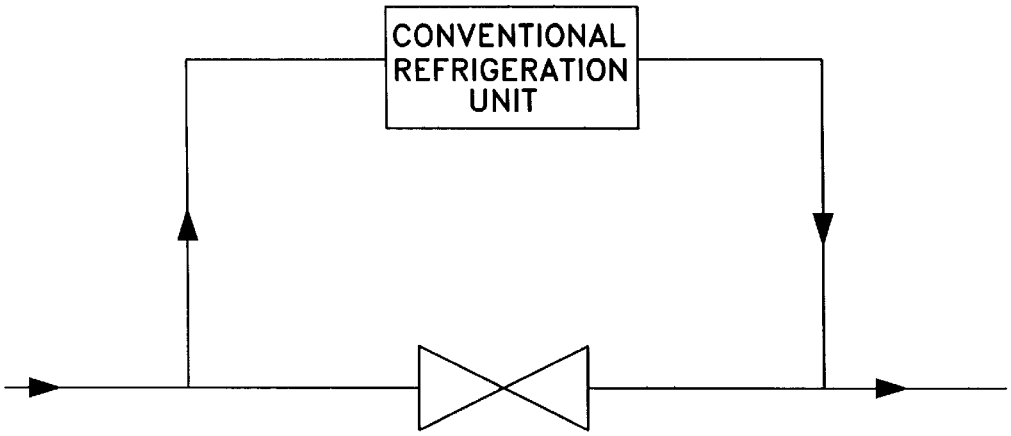
Fig. 3 (PRIOR ART)
FIG. 3 is a schematic drawing of a prior art temperature reduction system, in which a conventional refrigeration system is used to lower the gas temperature.
Figure 4:
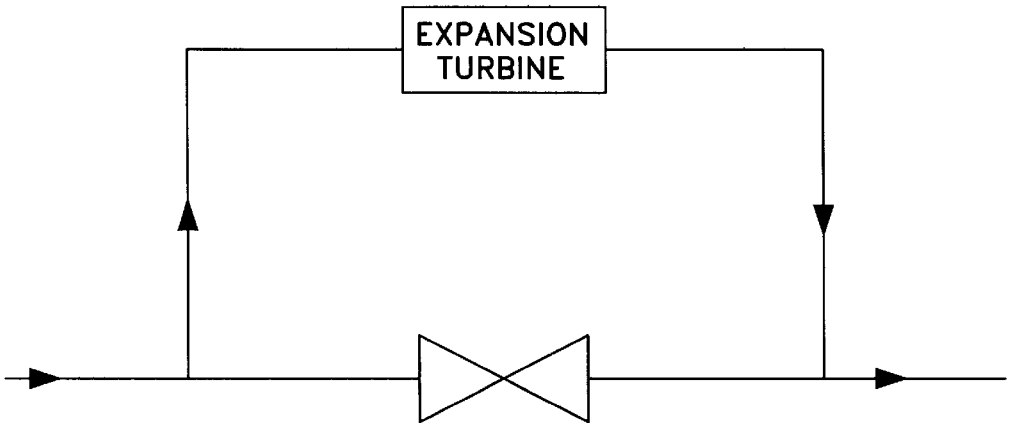
Fig. 4 (PRIOR ART)
FIG. 4 is a schematic drawing of a prior art temperature reduction system, in which a conventional expansion turbine is used to lower the gas temperature.

Conventionally, relatively long pressurized gas pipelines include several compressor stations, along with gas compression or combustion heaters for increasing the temperature of the gas as the temperature drops in the line, heat exchangers, and/or mechanical refrigeration units for reducing the temperature of the gas within the line at various points as desired. These gas characteristic control components (heaters, coolers, etc.) will benefit by the inclusion of J-T expansion valves in the line in accordance with the present invention, by requiring smaller temperature changes from such other control devices, and a corresponding savings in energy used to operate such devices. FIGS. 3 and 4 disclose respective prior art means for lowering the gas temperature in a pipeline, respectively by means of a refrigeration unit (FIG. 3) or expansion turbine (FIG. 4). While an expansion turbine may be used to produce some work from the pipeline gas, the energy removed from the gas results in a greater than desirable pressure loss.

In contrast, the present invention with its use of Joule-Thomson expansion valves for controlling the temperature of the gas flowing in a gas pipeline, does not require any additional energy for the operation of the valves, other than for instrumentation. Typically, the temperature and pressure changes at each valve are relatively small, thus requiring little in the way of additional capacity for a corresponding downstream compressor station. As an example of the above, the gas pressure at the entrance to a J-T valve may be on the order of 2,200 psig, with a temperature of plus thirty four degrees Fahrenheit, or just above freezing. If an area of permafrost lies downstream of the J-T valve, it is desirable to lower the temperature of the gas to a point below freezing. The corresponding pressure drop required to lower the gas temperature to thirty degrees Fahrenheit, is only about 133 psi, assuming pure methane for this example. In other words, the gas pressure at the exit of the J-T valve would be on the order of 2,067 psig.

In another example, the pipe may be operating entirely in the cold mode, with the entrance gas temperature at the J-T valve about 31 degrees Fahrenheit, or about one half degree below zero Celsius. With an entrance gas pressure of 2,200 psig, a drop in temperature to about 25 degrees Fahrenheit, or about four degrees below zero Celsius, using a J-T valve according to the present invention would result in a pressure drop of about 196 psi (again assuming pure methane), to an outlet pressure of about 2,204 psig. Other pressure drops associated with different temperature reductions may be calculated easily, in accordance with known physical gas laws.

As pipelines typically provide excess compressor capacity in anticipation of future production and use, enabling the gas to be compressed to a much greater degree, the present invention would not require additional compressor capacity or energy input, other than a slight increase in compressor output to compensate for the pressure drops produced by the J-T valves. However, the use of J-T valves in a pipeline according to the present invention, would likely result in a net savings of energy as additional compressors, heaters, coolers, etc. conventionally used to control the gas temperature as it flows through the pipeline, could be eliminated.

In summary, the present invention provides a significant advance in the art. By determining the actual and desired temperatures of gas flowing in a pipeline at various points along the line, and installing J-T valves at predetermined points along the line in accordance with the present invention, precise control of the flowing temperature profile of the gas pipeline may be achieved through regions of continuous or discontinuous permafrost. It will be seen that measuring the gas temperature at any given point, comparing it to the desired temperature, and installing and adjusting a J-T valve at that point, will provide the desired temperatures downstream of the valve.

Also, while the above discussion has not considered elevational changes, it will be seen that the present process of using J-T valves for the control of the temperature profile of a pressurized gas line also lends itself well to the control of temperatures in the line due to elevation changes. For example, a pressurized gas pipeline may be routed over a ridge or mountain range, with the increasing elevation resulting in a loss of pressure head in the gas as the elevation increases. This loss of pressure results in a corresponding loss of temperature. Accordingly, the installation of a J-T valve at the base of an uphill grade to reduce the temperature at the exit side of the valve to zero degrees Celsius or below, will result in the entire pipeline slope operating in the cold mode, due to the pressure drop due to increasing elevation, and the corresponding temperature drop.

While much of the discussion of the present invention has related to the control of temperatures downstream of a compressor station in a pipeline, it will be recognized that gas pipelines may conventionally include other gas control facilities installed therein as well. The J-T valve(s) of the present invention may be used in a pipeline to regulate gas flowing temperatures in the line downstream of any appropriate gas control facility, such as a compression or other heating facility and/or cooling facility, as well as downstream of a compression station, as desired.

Accordingly, the present inventive apparatus and process provide a much needed means of controlling the gas flow temperature profile in a gas pipeline, particularly through regions of continuous and discontinuous permafrost. The present invention will provide much needed increases in efficiency and corresponding cost savings in the gas pipeline transportation industry, by greatly reducing or eliminating the need for much of the energy consuming equipment heretofore used for controlling the temperature of gas in a pressurized pipeline, and by mitigating adverse impacts on the pipeline due to thaw settlement and frost heave through prevention of extreme pipeline operating temperatures which produce these impacts.

It is to be understood that the present invention is not limited to the embodiments described above, but encompasses any and all embodiments within the scope of the following claims.

I claim:

1. In a pressurized gas pipeline, an apparatus for cooling gas flow, said apparatus comprising:

a main pipeline remote from and between compressor stations;

a bypass pipeline communicating with said main pipeline, said bypass pipeline withdrawing gas from and reinserting gas into the main pipeline; and means for lowering the temperature of the gas in the bypass pipeline from a first predetermined temperature to a second predetermined temperature;

said means for lowering the temperature comprising at least one Joule-Thomson expansion valve disposed at a predetermined location in the bypass pipeline, for decreasing the pressure of the gas at the predetermined location from an entry gas higher first pressure upstream of said valve to an exit gas lower second pressure downstream of said valve, and correspondingly decreasing the temperature of the gas at the predetermined location from an entry gas predetermined higher first temperature upstream of said valve to an exit gas predetermined lower second temperature downstream of said valve.

2. The apparatus according to claim 1, including a shutoff valve disposed in the main pipeline, said bypass pipeline communicating with the main pipeline from upstream of said shutoff valve to downstream of said shutoff valve, with said bypass pipeline including said at least one expansion valve installed therein.

3. The apparatus according to claim 1, including means for automatically monitoring at least one characteristic of the entry gas, with the at least one characteristic being selected from the group consisting of pressure and temperature.

4. The apparatus according to claim 1, including means for automatically monitoring at least one characteristic of the exit gas, with the at least one characteristic being selected from the group consisting of pressure and temperature.

5. The apparatus according to claim 1, including means for automatically controlling at least one characteristic of the entry gas, with the at least one characteristic being selected from the group consisting of pressure and temperature.

6. The apparatus according to claim 1, including means for automatically controlling at least one characteristic of the exit gas, with the at least one characteristic being selected from the group consisting of pressure and temperature.

7. The apparatus according to claim 1, wherein said means for lowering the temperature of the gas in the bypass pipeline from a first predetermined temperature to a second predetermined temperature, comprises at least one expansion valve disposed at a corresponding predetermined location along the main pipeline.

8. A process for cooling gas flow in a pressurized gas pipeline, comprising:

providing a main pipeline remote from and between compressor stations;

installing at least one bypass pipeline at a predetermined location in the main pipeline;

installing at least one Joule-Thomson expansion valve in the at least one bypass pipeline; and passing all of the gas carried by the main pipeline, through the at least one bypass pipeline and through the at least one expansion valve; whereby the temperature and correspondingly the pressure of the gas exiting the Joule-Thomson expansion valve is reduced.

9. The process according to claim 8, with the process including installing a shutoff valve in the main pipeline, the bypass pipeline communicating with the main pipeline from upstream of the shutoff valve to downstream of the shutoff valve, and installing the at least one expansion valve in the bypass pipeline.

10. The process according to claim 8, with the process including automatically monitoring at least one characteristic of the entry gas, with the at least one characteristic being selected from the group consisting of pressure and temperature.

11. The process according to claim 8, with the process including automatically monitoring at least one characteristic of the exit gas, with the at least one characteristic being selected from the group consisting of pressure and temperature.

12. The process according to claim 8, with the process including automatically regulating at least one characteristic of the entry gas, with the at least one characteristic being selected from the group consisting of pressure and temperature.

13. The process according to claim 8, with the process including automatically regulating at least one characteristic of the exit gas, with the at least one characteristic being selected from the group consisting of pressure and temperature.

14. The process according to claim 8, with the process including using at least one expansion valve and installing the at least one expansion valve at a corresponding predetermined location along the main pipeline.

15. The process according to claim 8, with the process including operating the bypass pipeline in a mode selected from the group of modes consisting of a warm mode with the entry gas above zero degrees Celsius, and a cold mode with the entry gas at or below zero degrees Celsius.

16. The process according to claim 8, with the process including determining the predetermined location of the at least one expansion valve along the main pipeline by a flowing temperature profile of the main pipeline through a permafrost region.

* * * * *